US005246125A

United States Patent [19]

Julian

[11] Patent Number: 5,246,125

[45] Date of Patent: Sep. 21, 1993

[54] TAMPER INDICATING CLOSURE WITH ATTACHED TAMPER INDICATING BAND

[75] Inventor: Randall K. Julian, Evansville, Ind.

[73] Assignee: Sunbeam Plastics Corporation, Evansville, Ind.

[21] Appl. No.: 877,812

[22] Filed: May 4, 1992

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,346,811 | 8/1982 | Hilaire | 215/252 |
| 4,394,918 | 7/1983 | Grussen | 215/243 |
| 4,432,461 | 2/1984 | Mumford et al. | 215/252 |
| 4,480,761 | 11/1984 | Aichinger | 215/252 |
| 4,613,052 | 9/1986 | Gregory et al. | 215/252 |
| 4,664,278 | 5/1987 | Barriac | 215/252 |
| 4,664,279 | 5/1987 | Obrist et al. | 215/252 |
| 4,913,300 | 4/1990 | Wiedmer et al. | 215/252 |
| 5,056,675 | 10/1991 | Julian | 215/252 |

*Primary Examiner*—Allan N. Shoap
*Assistant Examiner*—Nova Stucker
*Attorney, Agent, or Firm*—Gifford, Groh, Sprinkle, Patmore and Anderson

[57] ABSTRACT

A tamper indicating closure having a threaded cap and a tamper indicating band connected to the cap by frangible webs and by a tether structure which permits threaded attachment of the closure to the container with the band positioned below an annular flange on the container so that unthreading of the cap permits deformation of the tether structure until all of the webs are fractured after which unthreading causes the tether structure to pull a localized area of the band over the annular flange to permit removal of the band and cap as a unit from the container.

11 Claims, 2 Drawing Sheets

TAMPER INDICATING CLOSURE WITH ATTACHED TAMPER INDICATING BAND

BACKGROUND OF THE INVENTION

1. Field of the Invention

This invention relates to tamper indicating closures for application to a container neck and more particularly to a tamper indicating closure in which separation of a tamper indicating band upon unthreading of the closure indicates tampering or prior removal but in which the tamper indicating band remains tethered to the cap for removal of the cap and tamper indicating band as a unit from the container.

2. Description of Related Art

A common form of tamper indicating closure incorporates a combined cap and tamper indicating band and uses a stop device for restraining axial movement of the tamper indicating band on the container neck. An inwardly directed lip or bead on the tamper indicating band seats below and acts with an outwardly directed bead or flange on the container neck. In the process of threading the closure on the container neck, the bead on the tamper indicating band snaps below the flange on the container neck. During unthreading, the band can rotate but is restrained against axial movement by the container flange so that frangible webs formed between the bottom of the cap and the top of the tamper indicating band are fractured primarily in tension. The broken webs give evidence of tampering and permit the unthreading of the cap from the container to give access to the contents of the container. It often is desirable to remove the tamper indicating ring from the container and provisions have been made for facilitating such removal either manually or in response to axial displacement of the cap relative to the container after the frangible webs between the cap and tamper indicating band have been fractured. In some such arrangements an axial line of weakening is provided to permit breaking or separation of the ring for removal and in other structures provision has been made for making one of the webs attaching the tamper indicating band to the cap stronger than the remaining webs so that upon removal of the cap all except the strong web break and permit removal of the cap and tamper indicating band as a unit on the container.

With closures in which the band remains attached to the cap by a single web or tether, the forces required for opening a container are not constant and are unpredictable because the webs between the tamper indicating band and cap do not break as intended, particularly those webs adjacent to the permanent web or tether. This results in the requirement for a greater opening force than intended to remove the tamper indicating band together with the cap from the closure.

SUMMARY OF THE INVENTION

The present invention eliminates many of the difficulties encountered with the prior art structures such as the incomplete fracture of all the frangible webs and the variation in force requirements for removal of a closure from a container. This is accomplished in a design incorporating a permanent tether structure which affords the unique movement of the cap relative to the tamper indicating band during unthreading of the cap from the container to insure that all of the frangible webs break. After the frangible webs are broken, the tether is arranged to become taut between the closure cap and the closure tamper indicating band. Further unthreading action pulls one side of the tamper indicating band over the bead so that tension in the tamper indicating band is released sufficiently and the band can be pulled from the container without the high forces and efforts required with a fully seated tamper indicating band.

DETAILED DESCRIPTION OF A PREFERRED EMBODIMENT

Figure 4:
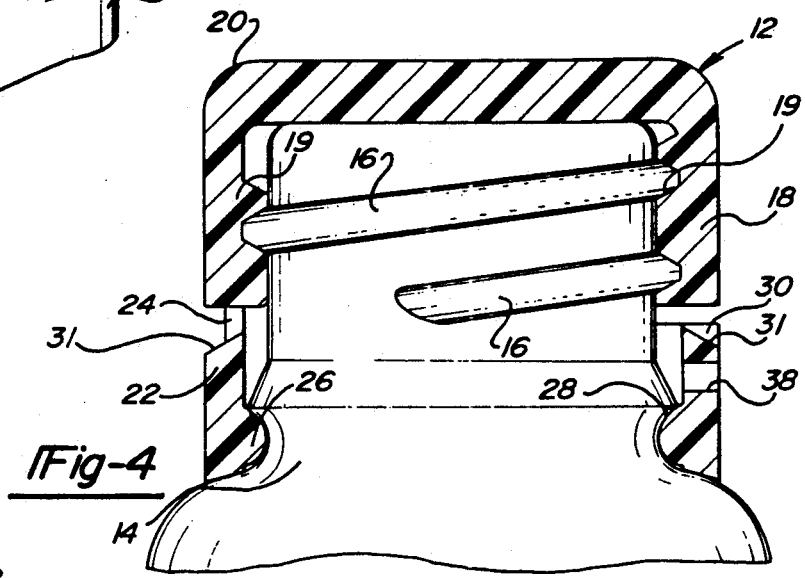
FIG. 4 is a cross-sectional view at an enlarged scale of the closure taken on line 4—4 in FIG. 5 showing its relative position to the container.

Referring to the drawings, the package embodying the invention comprises a container 10 and a closure 12. The container 10, as seen in FIG. 4, has a neck 14 with external threads 16 and the closure 12 has an annular skirt 18 with internal threads 19 complementary to the external threads 16 on the container neck. The closure 12 preferably is made of plastic such as a high density polyethylene and the container may be made of glass or plastic.

The closure 12 includes a cap 20 forming the skirt 18 and a tamper indicating band 22 which is coaxial with the annular skirt 18. The tamper indicating band 22 is temporarily attached to the cap skirt 18 by means of a plurality of spaced frangible webs 24. The frangible webs 24 serve to hold the skirt 18 and band 22 in concentric relationship during application of the closure assembly 12 to the container 10 and are fractured during opening of the package to indicate tampering.

The tamper indicating band 22 has a radially inwardly extending lip 26 complementary to a stop means or flange 28 on the neck 14 immediately below the external threads 16, as best seen in FIG. 4.

The tamper indicating band 22 also is provided with a plurality of platforms 30 disposed on the inclined top surface 31 of the tamper indicating band in space 32 formed between the bottom of the skirt 18 and the top 31 of the tamper indicating band 22. The tops of the platforms 30 are normally spaced from the bottom of the skirt 18. During application of the closure 12 to the container 10, axial force is applied to the closure 12 so that upon engagement of the lip 26 with the upper side of the flange 28, the platforms 30 are brought into engagement with the underside o of the skirt 18 to support the frangible webs 24 against collapse until the lip 26 snaps over and below the flange 28. Once the closure 12 is placed on the container 10 in this manner any attempt to remove the closure 12 brings into operation the tamper indicating features.

Figure 1:
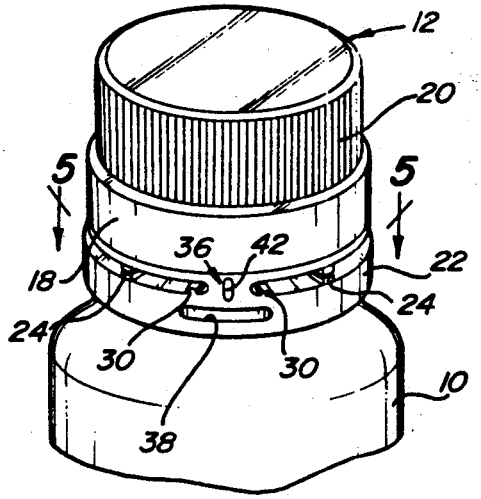
FIG. 1 is a perspective view of a closure embodying the invention positioned on the neck of a container which is broken away.

In addition to the frangible webs 24, the tamper indicating band 22 is attached to the skirt 18 by permanent means in the form of a tether structure 36. The tether structure 36 is formed by a circumferential slot 38 which extends through an arc of approximately 45°-50 degrees. The portion of the tamper indicating band above the slot 38 is connected to cap skirt 18 by a pair of permanent tether bands 40 separated from each other by an axially extending slot 42 best seen in FIGS. 1-3.

Figure 2:
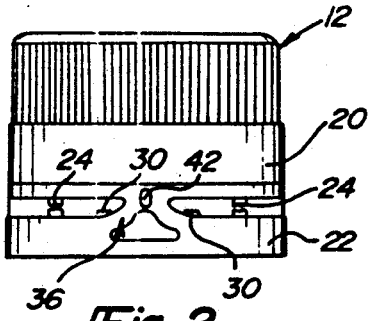
FIG. 2 is a side view of the closure in FIG. 1 showing the relative position of the parts after the cap has been partially unthreaded.

When the closure 12 is to be removed from the container 10 it is necessary to rotate the closure 12 in an unthreading direction. During such unthreading, the entire closure 12 including the cap 20 and tamper indicating band 22 tend to rotate on the neck 14. The engagement of the external threads 18 and internal threads 19 between the neck 14 and skirt 18 causes the skirt 18 to move axially or upwardly as seen in the drawings so that the webs 24 are placed in tension and fracture to separate the associated area of the tamper indicating band 22 from the cap skirt 18. At the same time that the frangible webs 24 are breaking, the axial movement of the skirt 18 causes the tether structure 36 to flex as best seen in FIG. 2. This flexing permits all of the frangible webs 24 to fracture completely including those webs closely adjacent to the tether structure 36. After all of the webs 24 are broken, the tether structure 36 becomes taut and continued unthreading of the cap 20 transmits an axial force only to that portion of the tamper indicating band 22 in the area of the slot 38. The portion of the tamper indicating band 22 below the slot 38 is narrower and more flexible than the remainder of the band 22 and is lifted over the hinge 28 on the container neck so that when the external threads 18 and internal threads 19 are fully unthreaded and disengaged, the cap can be used to pull the remainder of the tamper indicating band 22 from engagement with the flange 28 so that the entire closure 20, including the annular skirt 18 and tamper indicating band 22 are freed from the container neck.

The slot 42 serves the purpose of assuring that the tether structure 36 forms a permanent means of attachment between the cap and the tamper indicating band 22. The properties of some plastic materials used to make closures are such that any flaws or fractures that exist, tend to migrate or progress such as a crack in a pane of glass. If a flaw in one or the other of the tether bands 40 should occur, the slot 42 prevents any circumferential migration of any crack and maintains the integrity of the remaining tether band 40 which of itself is strong enough to lift the tamper indicating band 22 over the flange 28.

Figure 3:
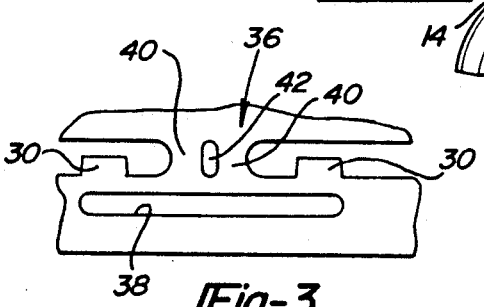
FIG. 3 is a fragmentary view at an enlarged scale of a portion of the structure seen in FIG. 1.
Figure 5:
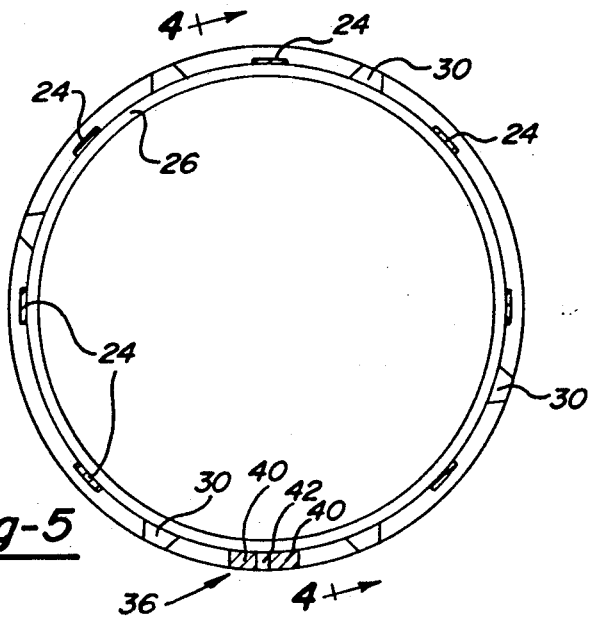
FIG. 5 is a view taken on line 5—5 in FIG. 1.

As seen in FIG. 3, platforms 30 are located at the ends of the slot 38 to insure transfer of axial forces from the cap skirt 18 to the band 22 and lip 26 as the closure 12 is positioned on a container 10 to close it.

Figure 6:
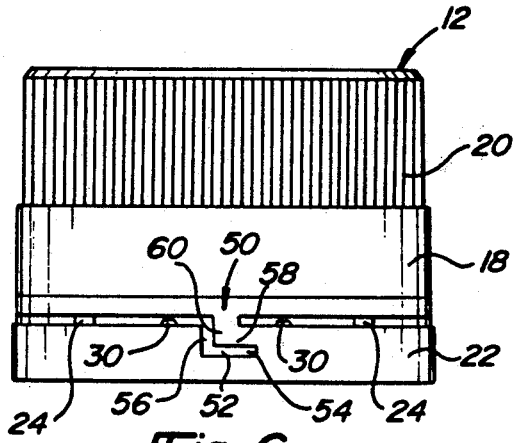
FIG. 6 is a view similar to FIG. 1 showing another embodiment of the invention.
Figure 7:
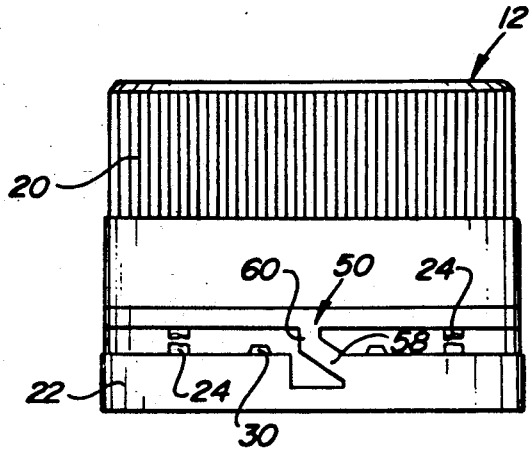
FIG. 7 is a view showing an operating position of the embodiment shown in FIG. 6.

Referring now to FIGS. 6 and 7, another embodiment of the invention is illustrated. In this embodiment a tether structure 50 is formed in the tamper indicating band 22 by an L-shaped slot 52 which is formed by a circumferentially extending slot portion 54 and an axial slot portion 56 to form a circumferential extending tang 58. The tang 58 merges with a permanent tether portion 60 which is formed integrally with cap 20. The remaining portions of the closure 12 are the same as those in the first embodiment.

In operation of the second embodiment of the invention, initial axial movement of the cap skirt 18 resulting from unthreading causes breakage of all of the frangible webs 24 during which time the axial movement relative to the axially stationary tamper indicating band 22 causes flexing of the tether 60 and tang 58 to assume the position shown in FIG. 7. After fracture of all of the frangible webs 24 the tether structure 50 formed by the tang 58 and tether portion 60 becomes sufficiently taut so that further unthreading of the cap and the resultant axial movement of the cap 20 tends to pull the portion of the tamper indicating band 22 adjacent to the tether structure 50 over the flange 28 to relieve the tension in the tamper indicating band 22 so that it can be stripped over the flange 28 and from the container 10.

Figure 8:
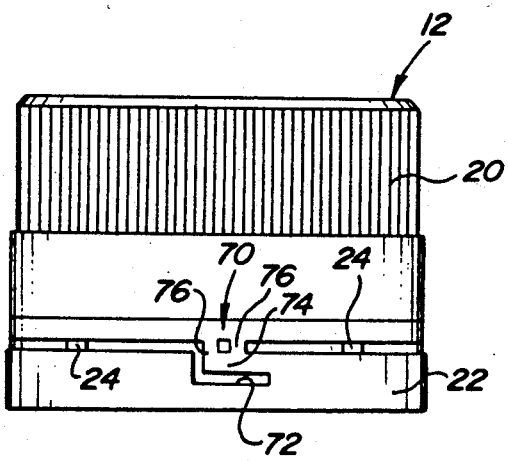
FIG. 8 is a view of still another embodiment of the invention similar to the view in FIG. 1.
Figure 9:
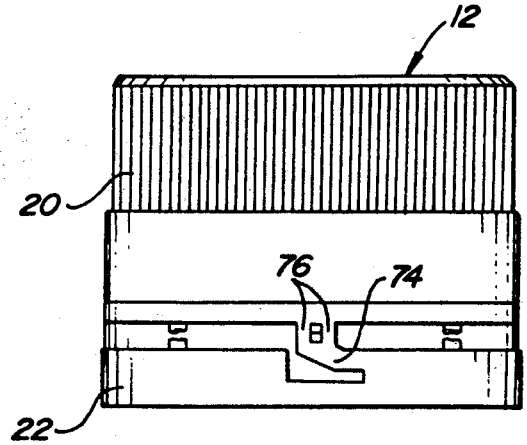
FIG. 9 is a view of an operating position of the embodiment shown in FIG. 8.

Another embodiment of the invention is seen in FIGS. 8 and 9 in which a tether structure 70 generally similar to the tether structure 50 in FIGS. 6 and 7 is employed. The tether structure 70 includes an L-shaped slot 72 in the tamper indicating band 22 which forms a circumferentially extending tang 74 attached to the skirt 18 of the cap 20 by means of a pair of permanent webs 76.

The embodiment in FIGS. 8 and 9 operates in substantially the same manner as the embodiment in FIGS. 6 and 7 and has the further advantage that the circumferential crack in either of the permanent webs 76 will leave the remaining webs 76 intact to pull the tang 74 and tamper indicating band 22 over the flange 28 upon unthreading of the cap.

I claim:

1. A tamper indicating closure having internal threads for application to an externally threaded container neck having an annular flange below the threads, the combination comprising:

a cap having an annular skirt portion, a tamper indicating band concentric with said skirt and having an annular lip engageable with the annular flange on said neck, means temporarily attaching said band to said skirt including frangible webs disposed over a substantial circumferential portion of said skirt and band, means permanently attaching the remaining circumferential portion of said band to said skirt including a tether structure, said tether structure including a circumferential slot in said remaining portion of said band and a permanent web structure connecting said band at a point in close proximity to said slot to said skirt, a vertical slot formed in said permanent web structure and extending transversely of a plane passing between said band and skirt to form two webs whereby failure of one of said webs leaves the other of said webs intact, said tether structure flexing during initial unthreading of said cap to permit fracture of said frangible webs and becoming taut during continued unthreading to lift the associated portion of said band over said flange for removal of said cap and band as a unit.

2. The combination of claim 1 wherein said web structure has a circumferential dimension less than the circumferential dimension of said slot.

3. A tamper indicating closure for use with a container having a threaded neck and an annular flange below the threads on said neck, the closure comprising:

a cap having an annular skirt a continuous annular tamper indicating band concentric with said skirt and including a radially inwardly extending continuous annular lip engageable with said annular flange to limit axial movement of said closure on said container, frangible webs holding said band relative to said skirt upon application of said closure to said container for the first time and being fractured during initial unthreading of said cap upon engagement of said lip with said flange and simultaneous axial displacement of said cap relative to said lip and flange, tether means permanently connecting said skirt and said continuous annular band between a localized area on the circumference of said skirt opposed to a localized area on said band and being deformable a predetermined amount to permit axial displacement of said localized area on said skirt relative to said localized area on said band while said entire band remains axially fixed during fracture of said frangible webs, said tether means being operative to lift said localized area of said band over said flange during unthreading of said cap after fracture of said frangible webs, and said band being removable from said container as a unit with said cap after complete unthreading of said cap.

4. The combination of claim 3 whereon said tether structure includes an L-shaped slot forming a circumferential projection in said band, and a permanent web means connecting said projection to said skirt.

5. The combination of claim 3 wherein said tether means includes a circumferential slot in said tamper indicating band and a permanent web structure formed integral with said cap and band adjacent to said slot.

6. The combination of claim 3 and further comprising support structures disposed circumferentially between said frangible webs to support said tamper indicating band in spaced relationship to said annular skirt during application of said closure to said container.

7. The combination of claim 5 wherein said support structures are disposed adjacent opposite ends of said slot.

8. The combination of claim 7 wherein said support structures are formed integrally with said band.

9. A tamper indicating, plastic closure for a container having a threaded neck portion and an annular flange below the threads, said closure comprising:

a cap having an annular skirt, a tamper indicating band disposed coaxially with said skirt and including a lip engageable with said annular flange to limit axial movement of said closure on said container, first means temporarily connecting first portions of said band to said skirt, second means permanently connecting second portions of said band to said skirt and including a tether structure permitting axial displacement of said skirt and band while maintaining said band connected to said skirt, said tether structure including an L-shaped slot forming a circumferential projection in said band and a permanent web means connecting said projection to said skirt, said permanent web means being formed by a pair of webs each of greater strength than said frangible web means, said closure being moveable axially during unthreading whereby said first means permits separation of said cap and said first portions followed by said second means lifting said second portions of said band over said flange for subsequent removal of said cap and band as a unit from said container.

10. A tamper indicating, plastic closure for a container having a threaded neck portion and an annular flange below the threads, said closure comprising:

a cap having an annular skirt, a tamper indicating band disposed coaxially with said skirt and including a lip engageable with said annular flange to limit axial movement of said closure on said container, first means temporarily connecting first portions of said band to said skirt, second means permanently connecting second portions of said band to said skirt, and including a tether structure permitting axial displacement of said skirt and band while maintaining said band connected to said skirt, said tether structure including a circumferential slot in said band and a permanent web structure connected to said band at a point substantially midway of said slot and to said skirt, said closure being moveable axially during unthreading whereby said first means permits separation of said cap and said first portions followed by said second means lifting said second portions of said band over said flange for subsequent removal of said cap and band as a unit from said container.

11. A tamper indicating, plastic closure for a container having a threaded neck portion and an annular flange below the threads, said closure comprising:

a cap having an annular skirt, a tamper indicating band disposed coaxially with said skirt and including a lip engageable with said annular flange to limit axial movement of said closure on said container, first means temporarily connecting first portions of said band to said skirt, second means permanently connecting second portions of said band to said skirt, said second means including a tether structure having a circumferential slot in said band and a permanent web structure adjacent to said slot connected to said skirt, said permanent web structure having an axial slot dividing said permanent web band over said flange, said closure being moveable axially during unthreading whereby said first means permits separation of said cap and said first portions followed by said second means lifting said second portions of said band over said flange for subsequent removal of said cap and band as a unit from said container.

* * * * *